US012702909B1

(12) United States Patent
Fries

(10) Patent No.: US 12,702,909 B1
(45) Date of Patent: Aug. 11, 2026

(54) SWING TRAINING APPARATUS AND METHOD

(71) Applicant: Jay David Fries, Bulverde, TX (US)

(72) Inventor: Jay David Fries, Bulverde, TX (US)

( * ) Notice: Subject to any disclaimer, the term of this patent is extended or adjusted under 35 U.S.C. 154(b) by 241 days.

(21) Appl. No.: 18/359,522

(22) Filed: Jul. 26, 2023

(51) Int. Cl.
*A63B 69/00* (2006.01)
*A63B 102/18* (2015.01)

(52) U.S. Cl.
CPC .. *A63B 69/0002* (2013.01); *A63B 2069/0008* (2013.01); *A63B 2102/18* (2015.10); *A63B 2102/182* (2015.10)

(58) Field of Classification Search
CPC ..... A63B 69/0002; A63B 2069/0008; A63B 2102/18; A63B 2102/182
USPC ..... 473/217, 270, 272, 273, 451, 452
See application file for complete search history.

(56) References Cited

U.S. PATENT DOCUMENTS 5,037,094 A * 8/1991 Johnson ..... A63B 69/0002 473/272
5,318,290 A * 6/1994 Sawyer ..... A63B 69/0002 473/217
5,810,673 A * 9/1998 Castleberry ..... A63B 69/3673 473/217
6,749,529 B1 * 6/2004 Sobolewski ..... A63B 22/14 473/451
8,221,271 B1 * 7/2012 Mcintyre ..... A63B 69/0002 473/272
8,485,913 B2 * 7/2013 Antolick ..... A63B 69/36 473/217
9,216,340 B2 * 12/2015 DelGreco ..... A63B 69/0002
11,426,644 B2 8/2022 Di Prima
2003/0224882 A1 * 12/2003 Mahoney ..... A63B 69/0002 473/452
2006/0142099 A1 * 6/2006 Trucks ..... A63B 69/0002 473/452
2008/0188331 A1 * 8/2008 Shimizu ..... A63B 26/003 473/451
2011/0218059 A1 * 9/2011 Leone ..... A63B 69/00 473/452
2011/0224028 A1 * 9/2011 Slakey ..... A63B 69/0002 473/452
2012/0190484 A1 * 7/2012 DelGreco ..... A63B 69/0002 473/452
2020/0338426 A1 * 10/2020 Di Prima ..... A63B 69/3673

* cited by examiner

*Primary Examiner* — Nini F Legesse
(74) *Attorney, Agent, or Firm* — Jackson Walker LLP; Edward B. Marvin; William R. Borchers

(57) ABSTRACT

The present disclosure relates to an apparatus and method to train a proper baseball or softball swing. More specifically, the disclosure concerns a first platform and a second platform pivotably mounted to the first platform. The pivotable mount causes a hitter executing a swing to focus on properly squaring his/her hips off to a pitcher and rotating or pivoting his/her back foot during the swing. The first platform may also be sized to address a common error of overstriding and/or stepping out of the batters' box, as well as to encourage proper weight distribution on the balls of the hitter's foot appendages. A hitter desiring to attain a fundamentally sound swing technique should position his/her front foot appendage on the first platform and his/her back foot appendage on the second platform, with the hitter's weight on the balls of his/her foot appendages. The hitter should then repeat swings using the proper swing technique discussed in the disclosure.

28 Claims, 5 Drawing Sheets

SWING TRAINING APPARATUS AND METHOD

CROSS-REFERENCES TO RELATED APPLICATIONS

None

BACKGROUND

1. Field of the Invention

The present invention relates to baseball or softball training. More specifically, the invention comprises an apparatus and method for training to perfect a baseball or softball swing.

2. Description of the Related Art

Baseball and softball swings require coordinated body movement that starts from the ground up. A hitter starts with his/her front hip toward a pitcher, standing with his/her legs shoulder width apart, his/her weight equally balanced on the balls of his/her feet, and a bat on or over his/her back shoulder. As the pitcher winds up, the hitter loads for the swing by shifting some of his/her weight toward his/her back leg and putting the bat in position to start the swing. As a pitched ball approaches, the hitter takes a small forward step (or stride) toward the pitcher while keeping most of his/her body weight on the ball of his/her back foot. As the ball approaches the strike zone, the hitter begins to twist his/her body so that both hips will eventually face toward (i.e., be squared off with) the pitcher. As the hitter twists his/her body to square off his/her hips with the pitcher, the hitter swings the bat by throwing his/her wrists in a downward arc so the bat follows on a path to the ball. Once the bat contacts the ball, the hitter generates power from his/her hip rotation while maintaining most of the hitter's weight on the back foot.

Properly squaring off the hips to generate power requires the hitter to rotate his/her back foot on the ground, but this movement can be difficult given that most of the hitter's weight is supposed to remain on the ball of his/her back foot. It is easier for the hitter to rotate his/her back foot without weight on it, so the hitter must concentrate to maintain the proper weight balance. Many hitters fail to execute the swing correctly due to the difficulty. Often there is a tendency for hitters to lunge their weight forward during the forward stride or during the arm portion of the swing, which is improper.

Additionally, hitters sometimes tend to not take a proper step forward with their front foot. Instead of stepping in a straight line toward the pitcher, the hitter may step at a diagonal toward left field (for right-handed batters) or right field (for left-handed batters). This improper technique is colloquially referred to as stepping out of the box, in reference to the batters' box area where the hitter stands. Stepping out the box moves the hitter away from the ball, thus causing a loss of power and/or pulling the swing path of the bat away from the ball.

Further, some hitters struggle to confine their forward stride to a small one. Taking too large of a stride (i.e., overstriding) throws off swing timing and promotes incorrect weight balance. Concerning timing, the hitter cannot begin squaring off his/her hips unless and until the forward stride is completed and the front foot is stable on the ground. Overstriding forces the hitter to rush the remaining parts of the swing or start his/her forward step earlier than desired. Additionally, overstriding causes the hitter's weight to balance along the midline of his/her body rather than the proper technique of keeping most of the weight on the ball of the hitter's back foot.

Finally, some hitters tend to stand flat footed instead of properly staying on the balls of their feet. In a proper swing, the hitter maintains his/her body weight on the balls of his/her feet so the hitter can better react to the pitch. Standing flat footed hampers the hitter's ability to adjust his/her swing to account for pitch variations (e.g., fastball, curveball, knuckleball, slider, screwball, etc.) that the hitter may encounter.

Thus, there exists a need for a swing training device that helps a hitter learn and replicate the proper swing technique. Such a swing training device would ideally be designed to address the common problems of lunging forward, taking too large of a forward stride, stepping out of the box, and standing flat footed, as well as to teach and emphasize the pivot or rotation of the hitter's back foot.

BRIEF SUMMARY

The present invention provides such an ideal swing training device. In this regard, the present invention generally comprises a primary platform that can be placed on a ground surface and on which the hitter stands to practice his/her swing technique. The primary platform is sized to ensure the hitter maintains his/her body weight on the balls of his/her feet, so that the hitter does not overstride, and so that the hitter does not step out of the box. The primary platform has a top side with a front half at least partially defined by a first surface, where the ball of the hitter's front foot is positioned.

A second platform is pivotably mounted to a rear half of the top side of the primary platform. The second platform has a second surface, on which the ball of the hitter's back foot is positioned. As the hitter begins to square off his/her hips with the pitcher and rotates his/her back foot, the pivot mount between the primary platform and the second platform allows the hitter's back foot to rotate with less resistance. As such, friction that is normally present between the ground surface and the hitter's back foot is significantly reduced, thereby forcing the hitter to focus on proper weight distribution and become familiar with the proper technique.

The first surface and the second surface are elevated from the ground to properly train the hitter. Preferably, the primary platform is mounted on a plurality of legs, with the plurality of legs being connected to each other and forming a polygonal base. The connection between the plurality of legs and the platform, and well as the connection of the plurality of legs to each other, may be a tongue and groove connection to facilitate assembly.

Additionally, the second surface of the second platform is preferably elevated from the ground surface to a height slightly greater than the height of the first surface from the ground surface. The slight difference in elevation between the second surface and the first surface prevents the hitter's back foot from dragging on the first platform during rotation and creates an emphasis on the hitter shifting most of his/her body weight to the back foot. These measures further help the hitter concentrate on properly rotating his/her back foot.

In use, the hitter stands with the balls of his/her feet properly positioned on the first surface and the second surface. The hitter executes his/her swing while standing on the two surfaces. The pivotable mount between the primary platform and the second platform focuses the hitter on properly rotating his/her hips and back foot, while the size and elevation of the primary platform forces the hitter to stay on the balls of his/her feet and prevents the hitter from overstriding or stepping out of the box.

DETAILED DESCRIPTION

Figure 1:
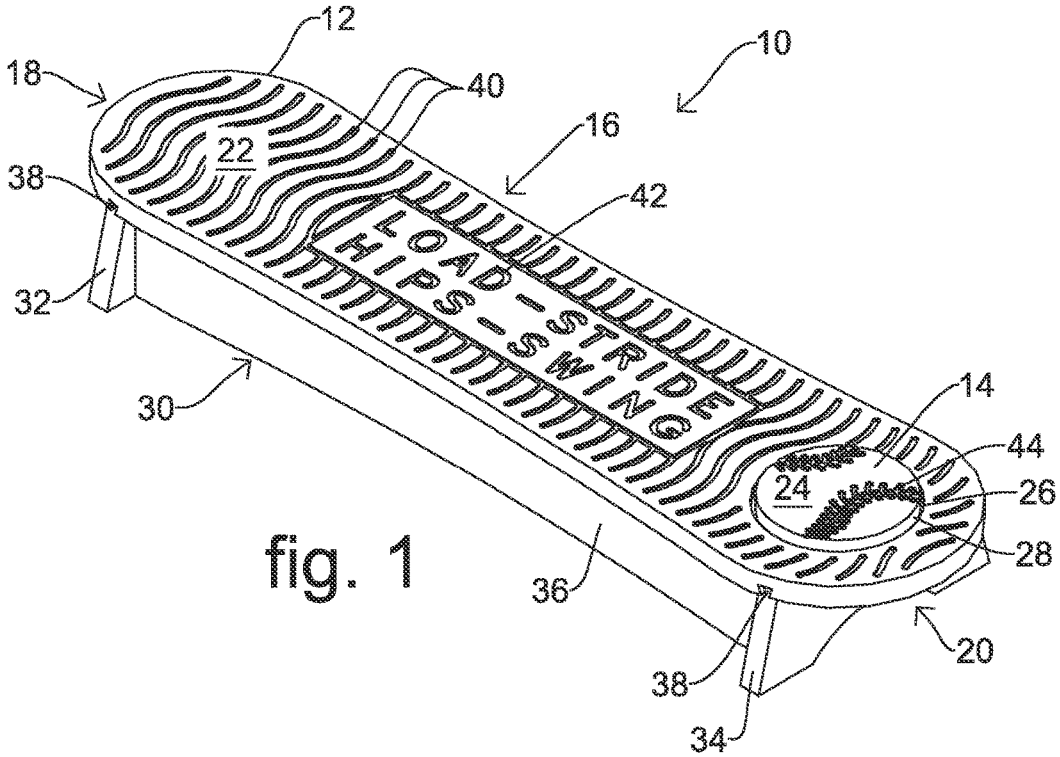
FIG. 1 shows a top perspective view of an embodiment of the present invention, showing a first platform and a second platform.

FIG. 1 shows an embodiment 10 of the present invention. Embodiment 10 generally comprises a first (or primary) platform 12 and a second platform 14. The first platform 10 has a top side 16 that faces upward when embodiment 10 is placed on a ground surface. The first platform 12 extends from a front end 18 to a rear end 20 and, in embodiment 10, the top side 16 is substantially planar. A first surface 22 of the first platform 12 defines most of the top side 16 in the embodiment 10. As shown, the first surface 22 extends to and around the second platform 14, terminating at the rear end 20 of the first platform 12.

The second platform 14 is pivotably mounted to the primary platform 12. It has a second surface 24 that faces away from the ground surface along a plane parallel to or coplanar with the first surface 22. In use, a hitter (not shown) places the ball of his/her front foot on the first surface 22 and the ball of his/her back foot on the second surface 24.

In the illustrated embodiment 10, the second platform 14 is pivotably mounted to the primary platform 12 within an indentation 26 in the top side 16 of the first platform 12. As shown, the second platform 14 is shaped as a cylinder with a sidewall 28 that is partially within indentation 26. In this regard, sidewall 28 extends partially into indentation 26 and a portion of the sidewall 28 extends out of indentation 26. Accordingly, the second surface 24 of the second platform 14 is slightly elevated away from the first surface 22 in the embodiment 10 and, during use, the second surface 24 is at a height from the ground surface that is slightly greater than the height of the first surface 22 from the ground surface. It has been found that a difference in elevation of five sixteenths of an inch (5/16") between the first surface 22 and the second surface 24 should suffice.

To help obtain a proper elevation, the first platform 12 may rest on a base 30. In the illustrated embodiment 10, base 30 is formed from a plurality of connected legs. FIG. 1 shows part of a front leg 32, part of a rear leg 34, and a right side leg 36. The front leg 32 and the rear leg 34 are connected to the primary platform 12 using a tongue and groove connection 38, as more fully discussed infra. For increased stability, the front and rear legs 32, 34 may expand outward as they extend away from the tongue and groove connection 38 toward the ground surface.

The embodiment 10 illustrated in FIG. 1 also shows several optional features. A plurality of grooves 40 within the first surface 22 decorate the surface and add traction, while writing 42 on the first surface 22 reminds hitters of the proper swing technique progression. Additionally, grooves 44 within the second surface 24 are arranged to mimic the stitch pattern of a baseball or softball and also serve to decorate the embodiment 10 as well as add traction. These features may be machined into the surfaces they occupy as shown, or may appear in other formats (e.g., as adhered grip tape or painted elements).

Figure 2:
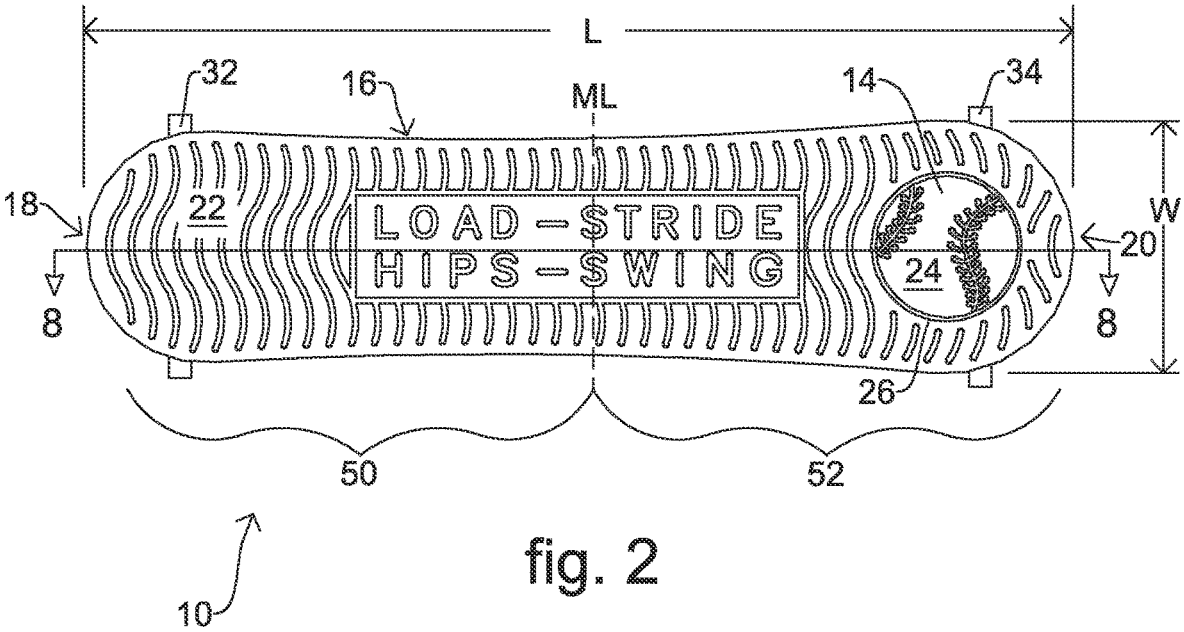
FIG. 2 shows a top plan view of the embodiment in FIG. 1.

Referring to FIG. 2, a midline ML is shown superimposed over embodiment 10. The midline ML is for illustration purposes to demonstrate separation of the top side 16 of the first platform 12 into a front half 50 and a rear half 52. The front half 50 of the top side 16 of the first platform 12 is at least partially defined by the first surface 22. In the embodiment 10, the first surface 22 also partially defines the rear half 52 of the top side 16 given its extension to and around the second platform 14. However, in alternative embodiments, the first surface 22 may not extend to the second platform 14 such as, for example, if the top side 16 was not generally planar.

The first platform 12 has a maximum length L and a maximum width W. The overall length and width of the first platform 12, however, may vary due to curvatures along the sides of the first platform 12. For example, in the illustrated embodiment 10, the overall width of the first platform 12 varies from its front end 18 to its rear end 20 due to the ends 18, 20 being rounded and a reduction in width at the midline ML. Additionally, the overall length of the first platform 12 may vary, for example, due to rounded ends 18, 20, such as in the illustrated embodiment 10. Thus, maximum length L is the greatest length of the first platform 12 while maximum width W is the greatest width of the first platform 12.

The first platform 12 is preferably sized to promote proper swing technique. For example, the maximum length L of the platform 12 should be no greater than thirty-six inches (36") so that the hitter cannot overstride. In this regard, with a properly sized first platform 12, too large of a forward step would cause the hitter's front foot to fall off the platform 12. The maximum length L may be smaller for smaller-sized hitters and should correspond to the size of the intended users. Ideally, the maximum length L would be in the range between thirty inches (30") and thirty-six inches (36").

Similarly, the maximum width W of the first platform 12 is designed to promote proper swing technique. The maximum width W should be no greater than twelve inches (12") so the hitter must remain on the balls of his/her feet and cannot step outside the box without falling off the platform 12. Ideally, the maximum width W would be in the range between six inches (6") and twelve inches (12").

Similar to the second platform 14, the indentation 26 in the illustrated embodiment 10 is also a cylinder. As shown, cylindrical indentation 26 shares a common center with the cylindrical second platform 14. Accordingly, a sidewall defining the cylindrical indentation 26 may be concentric with the previously discussed sidewall 28 of the second platform 14 as shown. It has been found that an ideal size for the second platform 14 is a cylinder having a diameter of four and three quarters inches (4¾") while the ideal size for the diameter of the cylindrical indentation 26 is five inches (5"), thus creating a quarter inch (¼") gap between the sidewall 28 and the sidewall of the indentation 26.

The top side 16 of the first platform 12 in the illustrated embodiment 10 is also preferably wider at the rear half 52 than the front half 50 to encourage proper foot alignment. For example, it has been found that a width of seven and three quarters inches (7¾") for the front half 50 and a width of eight and a half inches (8½") for the Rear half 52 is ideal.

FIG. 2 also shows the outward expansion of the front leg 32 and rear leg 34. The legs 32, 34 expand past the sides of the first platform 12 and, therefore, a portion of the legs 32, 34 is visible from above. Preferably, the legs 32, 34 extend transversely across the first platform 12, with the front leg 32 being eight and three quarters inches (8¾") long and the rear leg 34 being nine and one quarter inches (9¼") long. As such, the legs 32, 34 or other portions of the base 30 may extend beyond the maximum length L and/or the maximum width W.

Figure 3:
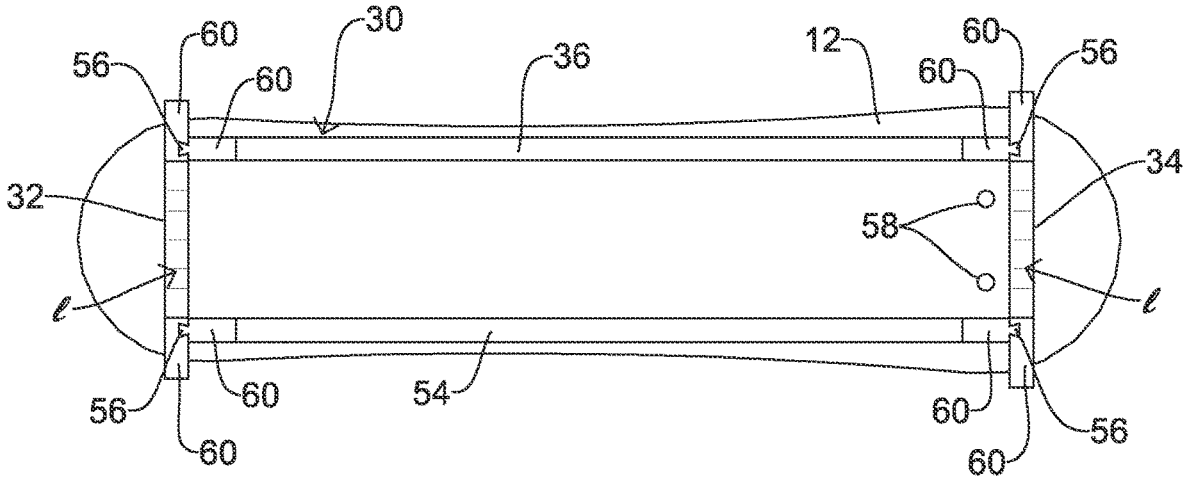
FIG. 3 shows a bottom plan view of the embodiment in FIG. 1.

Referring now to FIG. 3, the front leg 32 and the rear leg 34, as well as the right side leg 36 and a left side leg 54, are shown from a bottom view. The side legs 36, 54 extend between the front and rear legs 32, 34 and, together, the legs 32, 34, 36, and 54 form a polygonal base 30. Preferably, the two side legs 36, 54 are connected to the front and rear legs 32, 34 for added stability. In the embodiment 10, the two side legs 36, 54 are connected to the front and rear legs 32, 34 through a tongue and groove connection 56.

FIG. 3 also shows one or more weep holes 58 below indentation 26 (not shown) on the opposite side (i.e., on the top side 16) of the first platform 12. The weep holes 58 extend through the first platform 12 into the indentation 26 and, when present, allow water or other liquid to drain from the indentation 26.

FIG. 3 also shows ground contacts 60 where the respective legs 32, 34, 36, 54 of the embodiment 10 contact the ground surface during use. Each of the legs 32, 34, 36, 54 has two ground contacts 60 and a curvature between the two ground contacts 60. The curvatures separate part of the legs 32, 34, 36, 54 away from the ground surface. Such curvatures are illustrated, for example, by shading lines l applied to the front and rear legs 32, 34.

Figure 4:
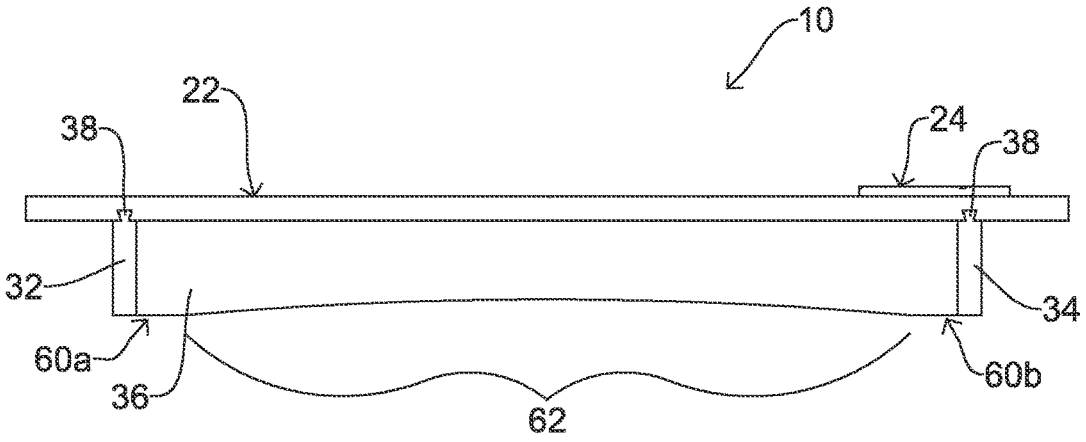
FIG. 4 shows a right side elevation view of the embodiment in FIG. 1.
Figure 5:
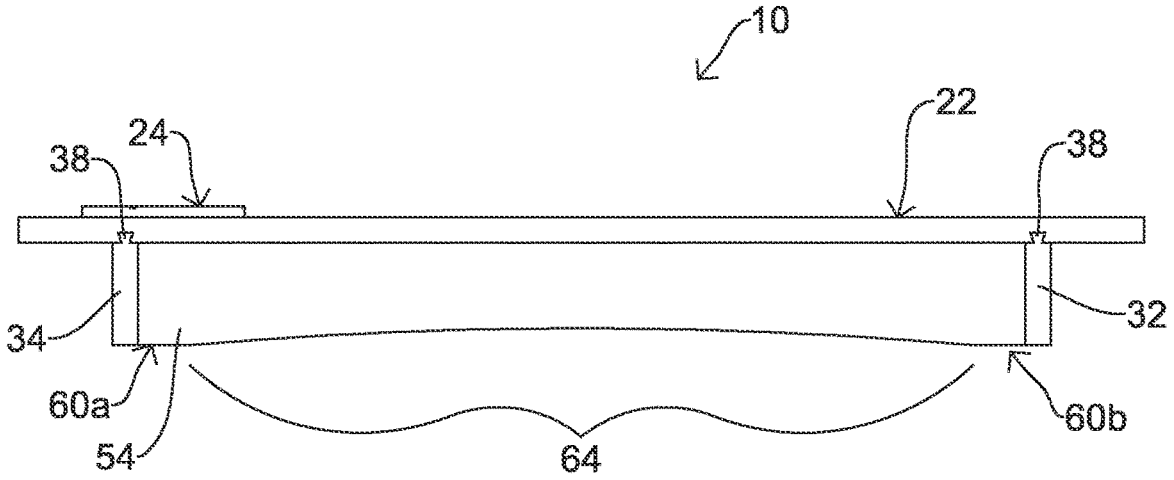
FIG. 5 shows a left side elevation view of the embodiment in FIG. 1.
Figure 6:
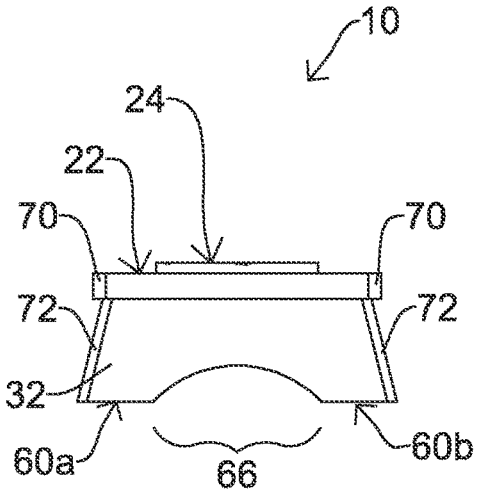
FIG. 6 is a front elevation view of the embodiment in FIG. 1
Figure 7:
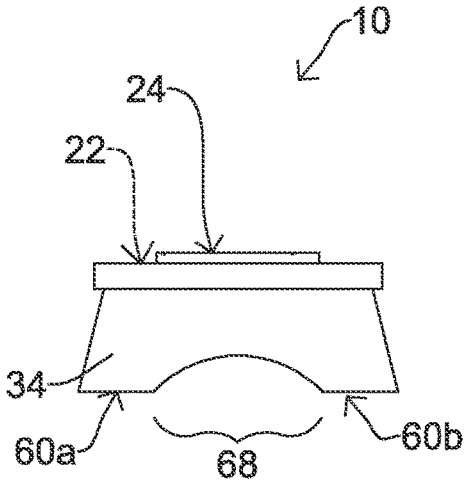
FIG. 7 is a rear elevation view of the embodiment in FIG. 1.

FIGS. 4-7 show side views of the embodiment 10, and better illustrate the curvatures in the legs 32, 34, 36, 54. As shown in FIG. 4, the right side leg 36 has a curvature 62 between a first ground contact 60*a* and a second ground contact 60*b*. Accordingly, the right side leg 36 does not touch the ground surface between its two respective ground contacts 60*a*, 60*b*. As shown in FIG. 5, the left side leg 54 has a curvature 64 between its first ground contact 60*a* and its second ground contact 60*b*, and the left side leg 54 does not touch the ground surface between its two respective ground contacts 60*a*, 60*b*. In FIG. 6, the front leg 32 has a curvature 66 between its first ground contact 60*a* and its second ground contact 60*b*, and the front leg 32 does not touch the ground surface between its two respective ground contacts 60*a*, 60*b*. Finally, as shown in FIG. 7, the rear leg 34 has a curvature 68 between its first ground contact 60*a* and its second ground contact 60*b*, and the rear leg 34 does not touch the ground surface between its two respective ground contacts 60*a*, 60*b*.

FIGS. 4-7 also better illustrate the difference in height between the first surface 22 and the second surface 24 in the embodiment 10. As shown, the second platform 14 slightly protrudes from the top side 16 of the first platform 12, thereby causing the second surface 24 to be elevated slightly higher than the first surface 22. In FIG. 7, the first surface 22 is shown with a dotted arrow because the first surface 22 is behind the second surface 24 in this illustrated view. Preferably, the height of the first surface 22 is in the range of two and one quarter inches (2¼") from the ground surface and four inches (4") from the ground surface.

FIGS. 4-5 also better illustrate the tongue and groove connection 38 between the front leg 32 and the first platform 12, as well as between the rear leg 34 and the first platform 12. Meanwhile, FIGS. 6 and 7 show the difference in width between the front and rear halves of the first platform 12, as well as the difference in length of the legs 32, 34. Concerning the former, in the front elevation view of FIG. 6 portions 70 of the rear half 52 of the first platform 12 can be seen extending wider due to the narrower front half 50, while such portions 70 cannot be seen in the rear elevation view of FIG. 7 due to the wider rear half 52. As to the latter, portions 72 of the rear leg 34 can be seen extending further outward due to the front leg 32 being not as long as the rear leg 34, while such portions 72 cannot be seen in the rear elevation view of FIG. 7.

Figure 8:
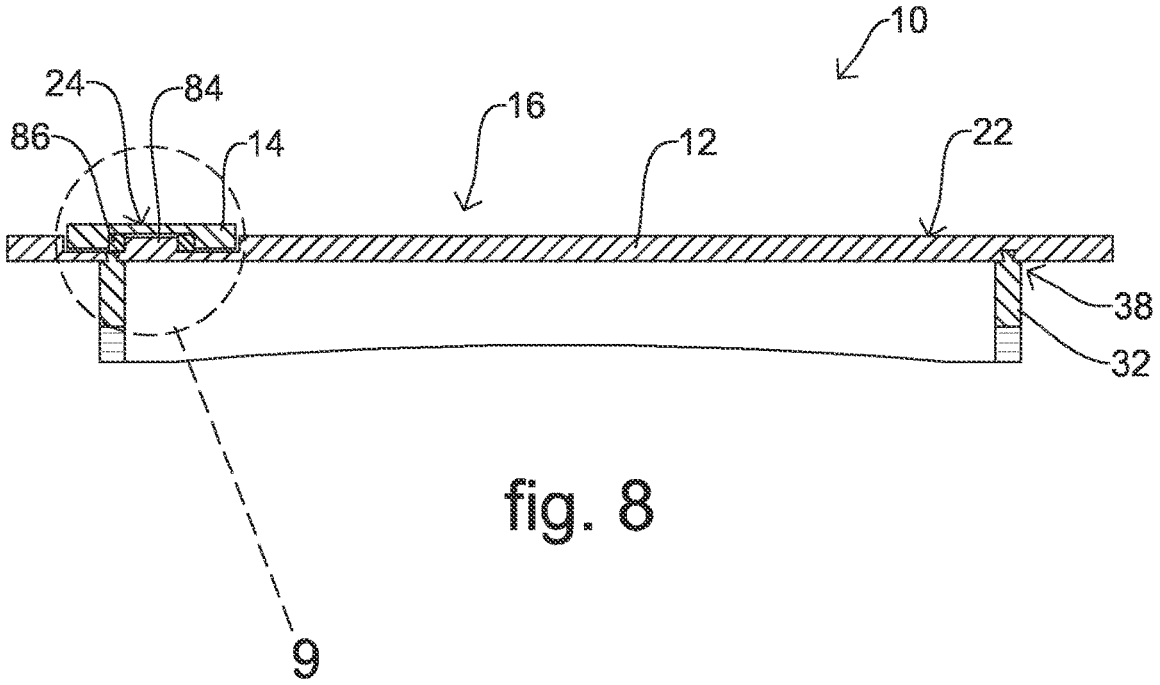
FIG. 8 is a cross-sectional view taken along section line 8-8 in FIG. 2.
Figure 9:
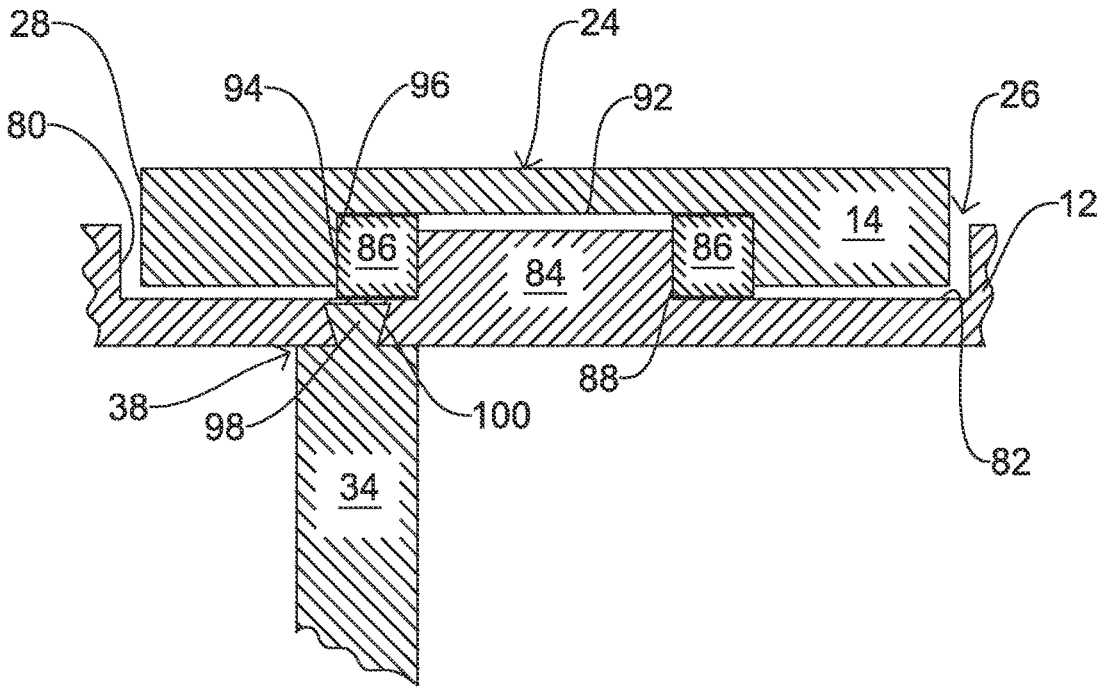
FIG. 9 is a close-up, cutaway view of a pivotable mount between the first platform and the second platform from FIG. 8.

FIGS. 8 & 9 show cross sectional views demonstrating how the second platform 14 is pivotably mounted to the first platform 12 in embodiment 10. As shown, the indentation 26 is defined by a sidewall 80 that extends from the top side 16 of the first platform 12 to a bottom surface 82. A protrusion 84 extends from the bottom surface 82 of the indentation 26 toward the second platform 14, and a bearing 86 is positioned between the protrusion 84 and the second platform 14.

Although bearing 86 may take on a variety of forms, in the embodiment 10, the protrusion 84 is cylindrical and bearing 86 comprises a ball bearing positioned around the protrusion 84 such that an inner circumference 88 of the bearing 86 is adjacent the sidewall of the protrusion 84. The second platform 14 has an inner indentation 92 that is also in the form of a cylinder, and the bearing 86 is positioned within the inner indentation 92 such than an outer circumference 94 of the bearing 86 is adjacent a sidewall 96 that helps define the inner indentation 92.

In FIG. 9, the second platform 14 is shown partially within the indentation 26 in the top side 16 of the first platform 12. In this regard, the sidewall 28 of the second platform 14 extends from the second surface 24—i.e., which is located out of the indentation 26 and elevated away from the first surface 22 as previously discussed-toward the bottom surface 82 of the indentation 26. Accordingly, part of sidewall 28 is out of the indentation 26 and part of sidewall 28 is within the indentation 26.

FIG. 9 also shows a close-up view of the tongue and groove connection 38 between the rear leg 34 and the first platform 12. As shown, a tongue 98 extending from the rear leg 34 is inserted into a corresponding groove 100 disposed in the first platform 12. The tongue and groove connection 38 between the front leg 32 and the first platform 12 is shown in FIG. 8 and mimics that which is shown in FIG. 9. In the illustrated embodiment 10, the tongue and groove connection 38 is in the form of a dovetail connection, but other types of tongue and groove connections are contemplated.

Figure 10:
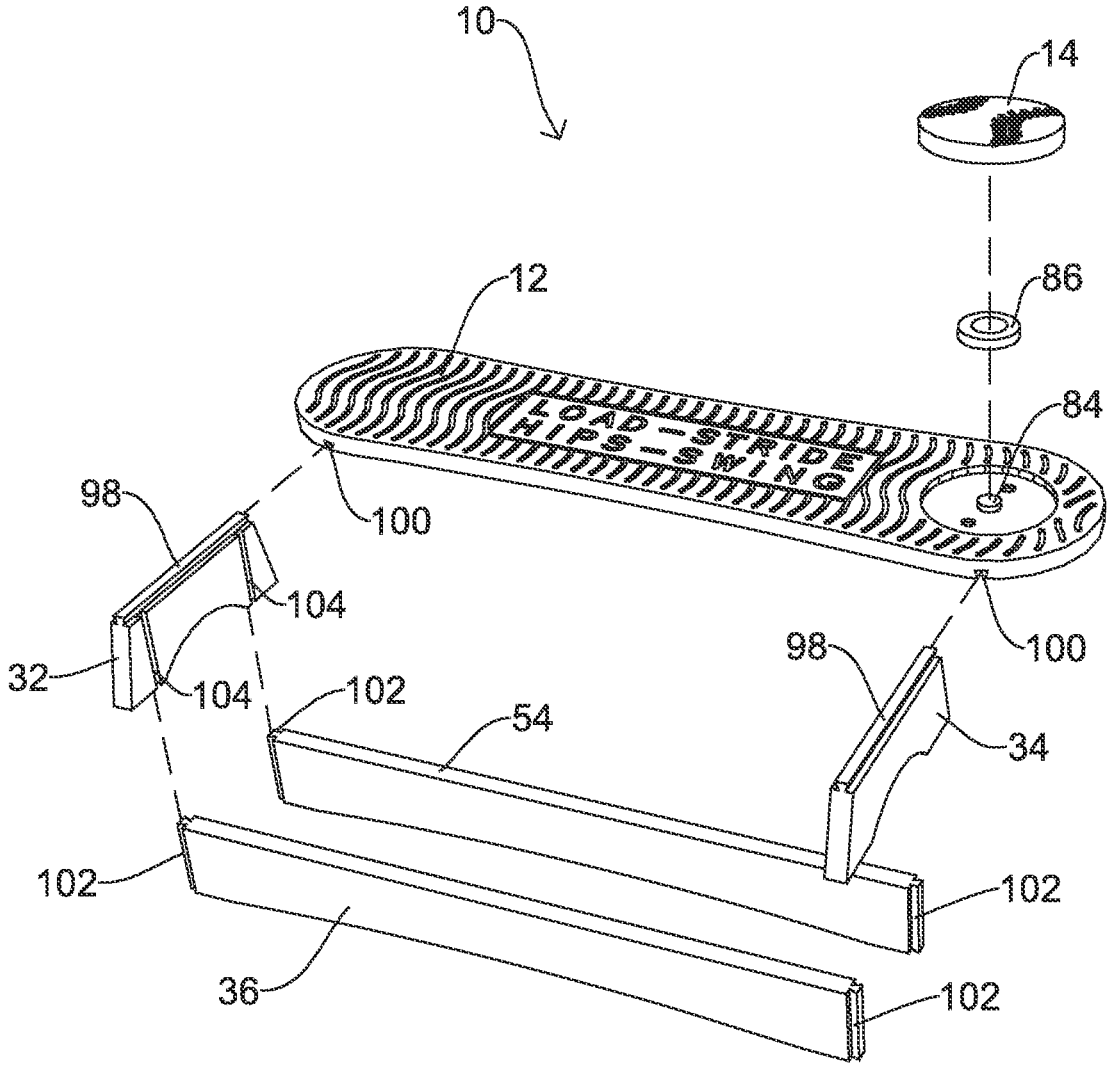
FIG. 10 is a perspective view of the embodiment in FIG. 1 with projected lines showing assembly of the embodiment.

FIG. 10 illustrates assembly of the embodiment 10. As shown, the bearing 86 is inserted onto the protrusion 84, and the second platform 14 is inserted onto the bearing 86 and partially within the indentation 26. The tongue 98 extending from each of the front and rear legs 32, 34 is inserted into its corresponding groove 100 disposed within the first platform 12. Similarly, a tongue 102 on each end of the right side leg 36 and on each end of the left side leg 54 is inserted into corresponding grooves 104 disposed within the front leg 32 or corresponding grooves (not shown) disposed within the rear leg 34.

To use the embodiment 10, a hitter places his/her front foot appendage onto the elevated first surface and his/her back foot appendage onto the elevated second surface. The hitter then executes a swing progression as previously described. During the swing progression, the second platform 14 rotates about its pivotable mount to the first platform 12 when the hitter rotates his/her back foot appendage. As previously discussed, the features of the embodiment 10 allow the hitter to focus on the proper swing technique, thereby creating a fundamentally sound swing.

The present invention is described in terms of a specifically described embodiment which is presented for purposes of illustration and not of limitation. Those skilled in the art will recognize that alternative embodiments of such device can be used in carrying out the present invention. Other aspects and advantages of the present invention may be obtained from a study of this disclosure and the drawings, along with the appended claims.

The invention claimed is:

1. A swing training apparatus for placement on a ground surface comprising:

a first platform having a top side with a front half and a rear half, said top side facing upward when the first platform is placed on the ground surface;

a first surface at least partially defining the front half of the top side, said first surface being elevated from the ground surface;

wherein the first platform is mounted on a plurality of legs, the plurality of legs comprising a front leg connected to the first platform, a rear leg connected to the first platform, and a longitudinal leg connected to the front leg and to the rear leg, each of said connections being formed through a tongue inserted into a groove;

a second platform pivotably mounted to the first platform, said second platform having a second surface that faces upward when the first platform is placed on the ground surface, said second surface being elevated from the ground surface to a height greater than the first surface; and wherein the first platform is sized to promote proper swing technique.

2. The swing training apparatus of claim 1 wherein the top side is substantially planar and the first surface extends to the second platform.

3. The swing training apparatus of claim 2 wherein the first surface extends around the second platform.

4. The swing training apparatus of claim 1 further comprising an indentation in the rear half of the top side and wherein the second platform is pivotably mounted to the first platform within said indentation.

5. The swing training apparatus of claim 4 wherein the second platform is at least partially within the indentation.

6. The swing training apparatus of claim 5 wherein the second platform is shaped as a cylinder.

7. The swing training apparatus of claim 5 wherein the indentation is shaped as a cylinder.

8. The swing training apparatus of claim 4 wherein the second platform further comprises a sidewall extending from the second surface toward the indentation.

9. The swing training apparatus of claim 8 wherein the indentation is defined by a sidewall within the first platform.

10. The swing training apparatus of claim 9 wherein the sidewall within the first platform is concentric with the sidewall extending from the second surface toward the indentation.

11. The swing training apparatus of claim 4 further comprising:

a bottom surface that at least partially defines the indentation;

a protrusion extending from the bottom surface toward the second platform; and wherein the second platform is attached to the protrusion.

12. The swing training apparatus of claim 11 further comprising a bearing between the protrusion and the second platform.

13. The swing training apparatus of claim 1 wherein the first platform and the second platform are configured to operate for right or left handed hitters, and the first platform has a maximum width not greater than twelve inches.

14. The swing training apparatus of claim 13 wherein the maximum width is not less than six inches.

15. The swing training apparatus of claim 1 wherein the first platform has an overall width that is not uniform.

16. The swing training apparatus of claim 15 where the overall width narrows between the front half and the rear half of the top side.

17. The swing training apparatus of claim 1 wherein the first platform has a maximum length not greater than thirty-six inches.

18. The swing training apparatus of claim 17 wherein the maximum length is not less than thirty inches.

19. The swing training apparatus of claim 1, wherein the front leg and the second leg may be disconnected from the first platform and the longitudinal leg by sliding the tongues out of the grooves.

20. The swing training apparatus of claim 1 wherein the legs in combination form a polygonal base.

21. The swing training apparatus of claim 20 wherein the legs are connected and each of said connections is formed through a tongue inserted into a groove.

22. A swing training apparatus for placement on a ground surface comprising:

a first platform having a top side with a front half and a rear half, said top side facing upward when the first platform is placed on the ground surface;

a first surface at least partially defining the front half of the top side, said first surface being elevated from the ground surface;

an indentation in the top side of the first platform;

wherein the first platform is mounted on a plurality of legs, the plurality of legs comprising a front leg connected to the first platform, a rear leg connected to the first platform, and a longitudinal leg connected to the front leg and to the rear leg, each of said connections being formed through a tongue inserted into a groove; and a second platform pivotably mounted to the first platform within the indentation.

23. The swing training apparatus of claim 22 wherein the second platform has a second surface that faces upward when the first platform is placed on the ground surface, said second surface being elevated from the ground surface to a height greater than the first surface.

24. The swing training apparatus of claim 22 wherein the second platform is shaped as a cylinder.

25. The swing training apparatus of claim 24 wherein the indentation is shaped as a cylinder.

26. The swing training apparatus of claim 25 wherein the second platform is at least partially within the indentation.

27. The swing training apparatus of claim 22 wherein the top side is substantially planar and the first surface extends to the second platform.

28. A swing training apparatus for a hitter having a foot appendage comprising:

a first platform with a top side having a front half and a rear half, said top side facing upward when the first platform is placed on the ground surface;

a first surface at least partially defining the front half of the top side, said first surface being elevated to a height;

a second platform pivotably mounted to the first platform, said second platform having a second surface that faces upward when the first platform is placed on the ground surface, said second surface being elevated to a height greater than the height of the first surface; and wherein the first platform has a maximum width less than 12 inches.

* * * * *